US005112799A

United States Patent [19]

Egashira et al.

[11] Patent Number: 5,112,799

[45] Date of Patent: May 12, 1992

[54] HEAT TRANSFER IMAGE-RECEIVING SHEET

[75] Inventors: Noritaka Egashira; Yoshinori Nakamura, both of Tokyo, Japan

[73] Assignee: Dai Nippon Insatsu Kabushiki Kaisha, Japan

[21] Appl. No.: 422,667

[22] Filed: Oct. 17, 1989

[30] Foreign Application Priority Data

Oct. 17, 1988 [JP] Japan ..... 63-259576
Oct. 21, 1988 [JP] Japan ..... 63-264026

[51] Int. Cl.[5] ..... B41M 5/035; B41M 5/26

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 4,908,345 3/1990 Egashira et al. ..... 503/227

OTHER PUBLICATIONS

McLafferty et al., *Journal of Coatings Technology*, pp. 23 and 25, vol. 58, No. 733, Feb. 1986.

Flory, Journal of the American Chemical Society, pp. 3083, 3085 and 3088–3089, vol. 63.

*Primary Examiner*—Bruce H. Hess

*Attorney, Agent, or Firm*—Parkhurst, Wendel & Rossi

[57] ABSTRACT

A heat transfer image-receiving sheet including a base sheet and a dye receiving layer formed on at least one surface of the base sheet. The dye receiving layer includes an acidic resin with acid value of 2 or more, or is formed primarily of a polyester resin with a branched structure.

7 Claims, No Drawings

HEAT TRANSFER IMAGE-RECEIVING SHEET

BACKGROUND OF THE INVENTION

This invention relates to a heat transfer image-receiving sheet, more particularly, to a heat transfer image-receiving sheet which can form a recorded image excellent in color forming density, sharpness and various fastnesses.

Various heat transfer methods have been known in the art, and among them, there has been practiced the sublimation transfer method, in which a sublimable dye is used as the recording agent. The sublimable dye is carried on a base sheet such as paper to provide heat transfer sheet, which is superposed on an image-receiving material capable of dyeing with a sublimable dye, for example, a fabric made of a polyester. The sublimable dye is migrated to the image-receiving material by applying heat energy according to pattern information from the back of the heat transfer sheet.

In the above sublimation transfer method, in the sublimation printing method, when the image-receiving material is, for example, a fabric made of a polyester, heat energy is imparted for a relatively longer time, and therefore the image-receiving material itself is heated by the heat energy imparted, whereby relatively good migration of the dye is accomplished.

However, with the progress in recording methods, when fine letters or figures or photographic images are to be formed on, for example, image-receiving materials having dye receiving layers provided on polyester sheets or papers at high speed by use of a thermal head, etc., heat energy is required to be imparted within a very short time of second units or less. Therefore, within such a short time, the sublimable dye and the image-receiving material cannot be heated, whereby no image with sufficient density can be formed.

Accordingly, in order to respond to such high speed recording, sublimable dyes excellent in sublimability have been developed. However, dyes excellent in sublimability have generally smaller molecular weights, and hence pose problems such as the dyes may be migrated with passage of time in the image-receiving material after transfer, or may be bleeded onto the surface, thus causing disturbance of the image elaborately formed to make them indistinct or contamination of surrounding articles.

In order to avoid such problems, if a sublimable dye having a relatively larger molecular weight is used, the sublimation speed in inferior in the high speed recording method as described above, and therefore no image with satisfactory density can be formed as described above.

SUMMARY OF THE INVENTION

Accordingly, an object of the present invention is to provide a heat transfer image-receiving sheet which gives a sharp image with sufficient density by imparting heat energy for a very short time as described above in a heat transfer method by use of a sublimable dye and yet providing an image formed which exhibits excellent various fastnesses.

The present invention is a heat transfer image-receiving sheet comprising a base sheet and a dye receiving layer formed on at least one surface of the base sheet. The dye receiving layer comprises an acidic resin with an acid value of 2 or more, or is formed primarily of a polyester resin having a branched structure.

In the present invention, the term "acid value" means the value indicating the quantity of a free acid such as a plasticizer. More particularly, this value means the quantity of potassium hydroxide by milligram necessary for neutralizing the free acid contained in 1 gram of a smple to be determined. In this case, the acid value is measured according to the method defined by JIS-K-5400 8.5.

By forming the receiving layer of a heat transfer image-receiving sheet of an acidic resin with an acid value of 2 or more, even when a dye with a relatively smaller molecular weight is used, the bleed resistance of the dye received can be improved to form an image excellent in sharpness, density and storability, etc. Also, even when a dye with relatively higher molecular weight is employed, due to excellent dye receptivity, an image excellent in sharpness, density and storability can be similarly formed.

Particularly, when a sublimable dye having basic amine, e.g., amino group, imino group or amide group, is used, the dye is captured with acidic groups within the receiving layer and therefore bleed resistance can be improved further.

Further, in the present invention, by forming the dye receiving layer of the heat transfer image-receiving sheet primarily of a polyester resin with a branched structure, the dye receiving layer will not be peeled off from the base material sheet even by imparting a high heat energy, whereby a heat transfer image-receiving sheet capable of giving a sharp image having sufficient density and resolution can be provided.

DETAILED DESCRIPTION OF THE INVENTION

The heat transfer image-receiving sheet of the present invention comprises a base sheet and a dye receiving layer formed on at least one surface thereof.

BASE SHEET

As the base sheet to be used in the present invention, there can be used synthetic papers (polyolefinic, polystyrenic, etc.), pure paper, art paper, coated paper, cast coated paper, wall paper, synthetic resin or emulsion impregnated paper, synthetic rubber latex impregnated paper, synthetic resin internally added paper, board paper, cellulose fiber paper, films or sheets of various plastics such as polyolefin, polyvinyl chloride, polyethylene terephthalate, polystyrene, polymethacrylate, polycarbonate which are not particularly limited.

It is also possible to use a laminated product comprising any combination of the above base sheets. A typical example of the laminated product may be a combination of a cellulose fiber paper and a synthetic paper, or a combination of a cellulose fiber paper and a plastic film or sheet.

FIRST EMBODIMENT OF DYE RECEIVING LAYER

The receiving layer to be formed on the above base sheet is provided for receiving the sublimable dye migrated from the heat transfer sheet and maintaining the image formed. The receiving layer is formed of various resins having acidic groups such as carboxyl group or sulfonic acid group in the molecules, and may be also formed from a mixture of a resin having these acidic groups and a resin having no acidic group. Particularly, it has been found in the present invention that excellent dye receptivity is exhibited when the acid value of the acidic resin employed is 2 or more. A preferable range of acid value is from 2 to 20. If the acid value is less than 2, bleed resistance or contamination resistance of a dye with relatively smaller molecular weight is insufficient, while if the acid value is over 20, receptivity of the dye with relatively higher molecular weight is undesirably insufficient.

The acidic resins to be used in the present invention may include acid modified resins modifying resins as mentioned below:

(a) those having ester bond, such as polyester resin, polyacrylate resin, polycarbonate resin, polyvinyl acetate resin, styrene-acrylate resin, vinyl tolueneacrylate resin, etc.;

(b) those having urethane bond, such as polyurethane resin, etc.;

(c) those having amide bond, such as polyamide resin (nylon);

(d) those having urea bond, such as urea resin, etc.;

(e) otherwise those having high polarity bond, such as polycaprolactone resin, polystyrene resin, polyvinyl chloride resin, polyacrylonitrile resin, etc.

Of the synthetic resins as mentioned above, particularly preferable is a polyester type resin.

The acidic resin as mentioned above can be obtained by modifying the resin with a polycarboxylic acid during or after synthesis of the resin. As the modification method, for example, in the case of condensation type resin such as polyester, polyurethane resin, polyamide resin, etc., there may be employed the method in which a polycarboxylic acid is used in excess or an acid of trivalent or more is used during synthesis, or in the case of a vinyl type resin, there may be employed the method in which a monomer having an acidic group as a part of the monomers used is used, to give a resin having a desired acid value.

Alternatively, when modified after synthesis, a resin having a group such as hydroxyl group, amino group, amide group, epoxy group, isocyanate group can be modified with a polycarboxylic acid to be modified into a resin with any desired acid value.

The polycarboxylic acid to be used for modification may include, for example, aliphatic polycarboxylic acids such as di- or tri-carboxylic acids or anhydrides thereof, as exemplified by oxalic acid, malonic acid, succinic acid, glutaric acid, adipic acid, pimellic acid, fumaric acid, maleic acid, methylmaleic acid, methylfumaric acid, itaconic acid, citraconic acid, mesacoic acid, acetylenic acid, malic acid, methylmalic acid, citric acid, isocitric acid, tartaric acid, edtc.; aromatic polycarboxylic acids such as phthalic acid, terephthalic acid, isophthalic acid, trimellitic acid, 1,2,3-benzenetricarboxylic acid, 1,3,5-benzenetricarboxylic acid, pyromellitic acid, benzenehexacarboxylic acid, naphthalene dicarboxylic acid, naphthalene tricarboxylic acid, naphthalene tetracarboxylic acid, diphenyltetracarboxylic acid, diphenylether tetracarboxylic acid, azobenzene tetracarboxylic acid or anhydrides thereof. In the present invention, a particularly preferable aromatic polycarboxylic acid is benzene tricarboxylic acid, particularly trimellitic acid or anhydride thereof.

The heat transfer image-receiving layer is obtained by coating and drying a solution of the above acidic resin or a mixture of this with a nonacidic resin dissolved in an appropriate organic solvent or a dispersion dispersed in an organic solvent or water on at least one surface of the above base sheet to form a dye receiving layer. When an acidic resin and a nonacidic resin are used in mixture, the acidic resin in the total of the both resins should be 5% by weight or more, preferably 10% by weight or more.

In forming the above receiving layer, for further enhancing the sharpness of transferred image by improving the whiteness of the receiving layer, a pigment or filler such as titanium oxide, zinc oxide, kaolin clay, calcium carbonate, fine powdery silica, etc. can be added. Also, for further enhancing light resistance of the transferred image, a UV-ray absorber and/or a light stabilizer can be also added in the receiving layer.

Such dye receiving layer may have any desired thickness, but generally a thickness of 3 to 50 μm. Also, such dye receiving layer should be preferably a continuous coating, but it may be also coated as an incontinuous coating by use of a resin emulsion or a resin dispersion.

The heat transfer image-receiving sheet of the present invention is sufficiently useful with the constitution basically as described above, but inorganic powder for sticking prevention can be also included in the dye receiving layer, and by doing so, sticking between the heat transfer sheet and the heat transfer image-receiving sheet can be prevented even if the temperature during heat transfer may be increased to effect further excellent heat transfer. Particularly preferably, fine powdery silica may be employed.

Also, in place of the inorganic powder such as silica as mentioned above, or in combination therewith, a resin with good releasability may be added also. A particularly preferable releasable polymer is a cured product of a silicone compound, for example, a cured product comprising an epoxy modified silicone oil and an amino modified silicone oil. Such release agent may be preferably added at a ratio comprising about 0.5 to 30% by weight of the dye receiving layer.

The heat transfer sheet to be used in performing heat transfer by use of the heat transfer image-receiving sheet of the present invention as described above comprises a dye layer containing a sublimable dye on a paper or a polyester film, and any of heat transfer sheets known in the art can be used as such in the present invention.

According to the study of the present inventors, it has been found that the dye to be used in the heat transfer sheet should be preferably a dye having at least one primary to tertiary amine, particularly that the best image can be formed when it is an indoaniline type, cyanoacetyl type or anthraquinone type dye as represented by the formulae shown below.

Dye No. 1

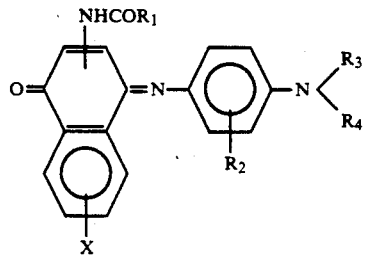

-continued

Dye No. 2

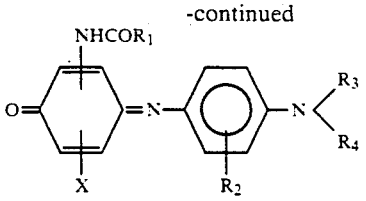

Dye No. 3

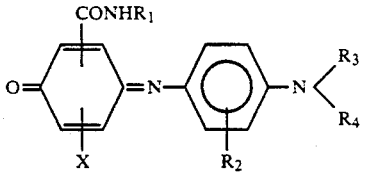

Dye No. 4

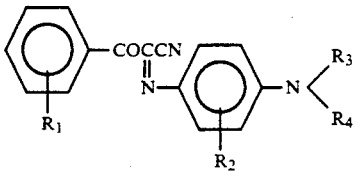

Dye No. 5

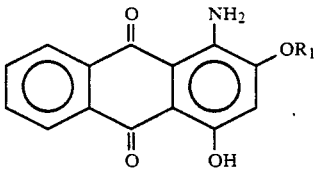

Dye No. 6

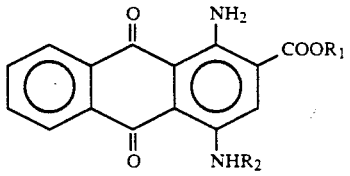

Dye No. 7

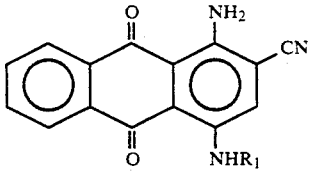

(In the above formulae, $R_1$ to $R_4$ each represent a $C_1$ to $C_6$ alkyl group, a cycloalkyl group or phenyl group, $R_2$ may be also hydrogen atom or alkoxy group, and $R_3$ and $R_4$ may also form a ring; X represents hydrogen atom, a substituent such as a halogen atom, a lower alkyl group, an alkoxy group, nitro group, etc.).

As the means for imparting heat energy during heat transfer, any of the imparting means known in the art can be used. For example, the desired object can be sufficiently accomplished by means of a recording device such as thermal printer (e.g., Videoprinter VY-100, manufactured by Hitachi K.K., Japan) by controlling the recording time to give a heat energy of about 5 to 100 mJ/mm$^2$.

According to the present invention as described above, by forming the dye receiving layer of the heat transfer receiving sheet of an acidic resin, a sharp image can be formed at high density. Particularly, since these images have excellent bleed resistance and contamination resistance, even when the images may be stored for a long term, the images will not be lowered in sharpness and may be contacted with other articles without contamination thereof, thus solving various problems of the prior art.

SECOND EMBODIMENT OF THE DYE RECEIVING LAYER

In the second embodiment of the present invention, the above receiving layer is characterized by being formed primarily of a branched polyester resin.

The branched polyester resin is one obtained by use of a polycarboxylic acid of 3 functionalities or more as a part of the acid component or a polyol of 3 functionalities or more as part of the alcohol component in preparing a linear polyester from a dicarboxylic acid and a diol.

Examples of the dicarboxylic acid to be used in the present invention may include phthalic acid, isophthalic acid, terephthalic acid, 1,2-, 1,4-, 1,5-, 1,6-, 1,7- or 2,4'-3,3'-4,4'-dicarboxylic acid, diphenyl-2,2'-2,3'-2,4'-3,3'-4,4'-dicarboxylic acid, diphenylmethane-2,2'-2,3'02,4'-3,3'04,4'-dicarboxylic acid, diphenyl ether 4,4'-dicarboxylic acid, benzophenone-4,4'-dicarboxylic acid, hexahydroterephthalic acid, hexahydroisophthalic acid adipic acid, succinic acid, maleic acid, sebacic acid, isosebacic acid, dimeric acid, tetrachlorophthalic acid, 4,4'-dicarboxy-diphenylmethane, 4,4'-dicarboxyldiphenylpropane, etc. Particularly preferable are isophthalic acid, terephthalic acid or derivatives thereof.

Examples of trivalent or higher polycarboxylic acids may include trimellitic acid, trimesic acid, 1,2,5-, 2,3,6- or 1,8,4-naphthalene tricarboxylic anhydride, 3,4,4'-diphenyltricarboxylic anhydride, 3,4,4'-diphenylmethanetricarboxylic anhydride, 3,4,4'-diphenylethertricarboxylic anhydride and 3,4,4'-benzophenonetricarboxylic anhydride, and particularly useful is trimellitic acid. Of course, derivatives such as esters or anhydrides of the above di- or polyacides may be also employed.

Examples of diol may include ethylene glycol, diethylene glycol, triethylene glycol, tetraethylene glycol, 1,2-propylene glycol, dipropylene glycol, 1,3-propane diol, various butane-, pentane- or hexane diols, such as 1,3- or 1,4-butane diol, 1,5-pentene diol, 1,6-hexane diol, 1,4-butene-2-diol, 2,2-dimethylpropane diol-1,3, 2-ethyl-2-butyl-propane diol-1,3, 1,4-dimethylolcyclohexane, 1,4-butene diol, hydrogenated bisphenols (e.g., hydrogenated P,P'-dihydroxydiphenylpropane or homologues thereof), cyclic glycol, such as 2,2,4,4-tetramethyl-1,3-cyclobutane diol, hydroquinone-di-$\beta$-hydroxyethyl ether, 1,4-cyclohexane dimethanol, 1,4-cyclohexane diethanol, trimethylene glycol, hexylene glycol, octylane glycol, etc. Particularly preferable are ethylene glycol, 1,2-propylene glycol and 1,6-hexane diol.

Examples of trivalent or higher polyol may include glycerine, 1,1,1-trimethylolethane, 1, 1,1-trimethylolpropane, etc., particularly preferably glycerine or derivatives thereof.

The branched polyester to be used in the present invention is prepared from the components as described above in conventional manner, and the trivalent or higher polycarboxylic acid or polyol used in this case should be preferably used at a ratio comprising 0.5 to 50 equivalent %, preferably 1.0 to 10 equivalent % in the acid components or the alcohol components to give a branched structure.

If the amount of the polycarboxylic acid or the polyol used is too small, adhesiveness of the polyester resin obtained to the base material sheet is deficient, while if it is too much, gelling occurs to make the sheet unavailable.

The heat transfer image-receiving sheet of the present invention is obtained by coating and drying a solution of the branched polyester resin as described above or a mixture of this with other resins dissolved in an appropriate organic solvent or a dispersion dispersed in an organic solvent or water to form a dye receiving layer. When the branched polyester and another resin are used in a mixture, the branched polyester resin should be preferably 5% by weight or more, preferably 10% by weight or more, in the total of the both.

In forming the above receiving layer, for further enhancing the sharpness of transferred image by improving the whiteness of the receiving layer, a pigment or filler such as titanium oxide, zinc oxide, kaolin clay, calcium carbonate, fine powdery silica, etc. can be added. Also, for further enhancing light resistance of the transferred image, a UV-ray absorber and/or a light stabilizer can be also added in the receiving layer.

Such dye receiving layer may have any desired thickness, but generally a thickness of 3 to 50 μm. Also, such dye receiving layer should be preferably a continuous coating, but it may be also coated as an incontinuous coating by use of a resin emulsion or a resin dispersion.

The heat transfer image-receiving sheet of the present invention is sufficiently useful with the constitution basically as described above, but inorganic powder for sticking prevention can be included also in the dye receiving layer, and by doing so, sticking between the heat transfer sheet and the heat transfer image-receiving sheet can be prevented even if the temperature during heat transfer may be increased to effect further excellent heat transfer. Particularly preferably, fine powdery silica may be employed.

Also, in place of the inorganic powder such as silica as mentioned above, or in combination therewith, a resin with good mold releasability may be also added. A particularly preferable mold releasable polymer is a cured product of a silicone compound, for example, a cured product comprising an epoxy modified silicone oil and an amino modified silicone oil. Such mold release agent may be preferably added at a ratio comprising about 0.5 to 30% by weight of the dye receiving layer.

The heat transfer sheet to be used in performing heat transfer by use of the heat transfer image-receiving sheet of the present invention as described above comprises a dye layer containing a sublimable dye on a paper or a polyester film, and any of heat transfer sheets known in the art can be used as such in the present invention.

According to the study by the present inventors, it has been found that the dye to be used in the heat transfer sheet should be preferably a dye having at least one primary to tertiary amine, e.g., amino group, imino group or amide group, particularly that the best image can be formed when it is an indoaniline type, cyanoacetyl type or anthraquinone type dye.

As the means for imparting heat energy during heat transfer, any of the imparting means known in the art can be used. For example, the desired object can be sufficiently accomplished by means of a recording device such as thermal printer (e.g., Videoprinter VY-100, manufactured by Hitachi K.K.) by controlling the recording time to give a heat energy of about 5 to 100 $mJ/mm^2$.

According to the present invention as described above, by forming the dye receiving layer of the heat transfer receiving sheet of a polyester resin having the branched structure, particularly a heat transfer image-receiving sheet can be provided, which give a sharp image having sufficient density and resolution even by imparting high energy without peel-off of the dye receiving layer from the base material sheet.

The present invention is described in more detail by referring to Examples and Comparative examples. In the description, "parts" and "%" are based on weight unless otherwise particularly noted.

EXAMPLE A1

An ink composition for forming a dye carrying layer having a composition shown below was prepared, and applied and dried to a dried coating amount of 1.0 $g/m^2$ on a polyethylene terephthalate film with a thickness of 6 μm applied with heat-resistant treatment on the back to obtain a heat transfer sheet shown below in Table A1.

Dye of the above formula: 3.0 parts
Polyvinyl butyral resin: 4.5 parts
Methyl ethyl ketone: 46.25 parts
Toluene: 46.25 parts However, in the above composition, when the dye mixture was insoluble, DMF, dioxane, chloroform, etc. were employed as the solvent.

TABLE 1

| Dye and Sheet No. | $R_1$ | $R_2$ | $R_3$ | $R_4$ | X |
|---|---|---|---|---|---|
| 1 | $-CH_3$ | $-CH_3$ | $-C_3H_7$ | $-C_3H_7$ | Cl |
| 2 | $-C_2H_5$ | $-CH_3$ | $-C_2H_5$ | $-C_4H_9$ | $-CH_3$ |
| 3 | $-CH_3$ | $-CH_3$ | $-CH_3$ | $-C_4H_9$ | Cl |
| 4 | $-CH_3$ | $-C_2H_5$ | $-CH_3$ | $-C_2H_5$ | $-CH_3$ |
| 5 | $-CH_3$ | — | — | — | — |
| 6 | $-CH_3$ | $-CH_3$ | — | — | — |
| 7 | $-C_5H_{11}$ | — | — | — | — |

also, by use of the following dye, heat transfer sheet 8 was obtained in the same manner as above method.

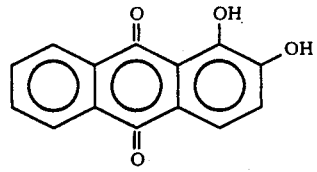

(C.I. Natural Red 8)

Next, by use of a synthetic paper (Yupo FPG #150, manufactured by Oji Yuka K.K., Japan) as the base material sheet, a coating liquid with a composition shown below was coated on one surface to 10.0 $g/m^2$ on drying, followed by drying at 100° C. for 30 minutes to give a heat transfer image-receiving sheet shown in Table A2.

Acidic resin in Table A2 shown below: 11.5 parts
Vinyl chloride-vinyl acetate copolymer (VYHH, manufactured by UCC: 5.0 parts
Amino-modified silicone (KF-393, manufactured by Shinetsu Kagaku Kogyo K.K., Japan): 1.2 parts
Epoxy-modified silicone (X-22-343, manufactured by Shinetsu Kagaku Kogyo K.K., Japan): 1.2 parts
Methyl ethyl ketone/Toluene/Cyclohexanone (weight ratio 4:4:2): 102.0 parts

TABLE A2

| | |
|---|---|
| No. 1: | polyester resin (acid value 0.6) modified with trimellitic anhydride: acid value: 4.8; |

TABLE A2-continued

| | |
|---|---|
| No. 2: | the same as above with acid value of 2; |
| No. 3: | the same as above with acid value of 5; |
| No. 4: | the same as above with acid value of 6; |
| No. 5: | the same as above with acid value of 9; |
| No. 6: | the same as above modified with phthalic anhydride: acid value 4.7; |
| No. 7: | the same as above modified with maleic anhydride: acid value 4.4; |
| No. 8: | the same as above modified with succinic anhydride: acid value 4.7; |
| No. 9: | No modification (Comparative example): acid value 0.6 |

The above heat transfer sheet and the heat transfer image-receiving sheet were superposed with the respective dye layer and the dye receiving surface faced to each other, and recording was performed with a thermal head from the back of the heat transfer sheet under the conditions of a heat application voltage of 10V, a printing time of 4.0 msec. to obtain the results shown below in Table A3.

TABLE A3

| Heat transfer sheet | Image-receiving sheet | Color forming density | Fastness |
|---|---|---|---|
| 1 | 1 | 1.20 | ◎ |
| 2 | 2 | 1.20 | ◎ |
| 3 | 3 | 1.30 | ◎ |
| 4 | 4 | 1.50 | ◎ |
| 5 | 5 | 1.40 | ○ |
| 6 | 6 | 1.02 | ◎ |
| 7 | 7 | 1.10 | ◎ |
| 1 | 8 | 1.05 | ◎ |
| 1 | 9 | 1.00 | Δ |
| 8 | 1 | 0.80 | X |
| 8 | 1 | 0.75 | X |

Color forming density is a value measured by Densitometer RD-918, manufactured by Macbeth, U.S.A.

Fastness is represented by ◎ when sharpness of the image is not changed and also the white paper is not colored when the surface is frictioned with a white paper after the recorded image has been left to stand for a long time in an atmosphere of 50° C., by ○ when sharpness is slightly lost after the recorded image has been left to stand for a long time in an atmosphere of 50° C. and the white paper is slightly colored, by Δ when sharpness is lost and the white paper is colored, and by × when the image becomes indistinct and the white remarkably colored.

Reference example B1

Terephthalic acid: 66 parts (4 equivalents)
Isophthalic acid: 100 parts (6 equivalents)
Ethylene glycol: 28 parts (4.5 equivalents)
Trimethylol propane: 7 parts (0.5 equivalent)
Bisphenol A: 114 parts (5 equivalents)

The above components were charged into a reactor, elevated in temperature to 150° C. for 3 hours in a nitrogen atmosphere with the use of antimony trioxide as the catalyst, and the reaction was carried out at this temperature for one hour, followed further by dehydrating polycondensation under the conditions of 275° C., 0.1 to 0.15 mmHg for 2 hours, to obtain a branched polyester resin.

Reference example B2

By use of the following components, a branched polyester resin was obtained in the same manner as in Reference example B1.

Terephthalic acid: 83 parts (5 equivalents)
Isophthalic acid: 66 parts (4 equivalents)
Trimellitic acid: 21 parts (1 equivalent)
Ethylene glycol: 31 parts (5 equivalents)
Bisphenol A: 68 parts (3 equivalents)
Propylene glycol: 15 parts (2 equivalents)

Reference example B3

Terephthalic acid: 66 parts (4 equivalents)
Isophthalic acid: 66 parts (4 equivalents)
Trimellitic acid: 42 parts (2 equivalents)
Ethylene glycol: 25 parts (4 equivalents)
Trimethylol propane: 13 parts (1 equivalent)
Bisphenol A: 114 parts (5 equivalents)
Propylene glycol: 15 parts (2 equivalents)

Comparative reference example B1

Terephthalic acid: 66 parts (4 equivalents)
Isophthalic acid: 66 parts (4 equivalents)
Sebacic acid: 40 parts (2 equivalents)
Ethylene glycol: 31 parts (5 equivalents)
Bisphenol A: 46 parts (2 equivalents)
Propylene glycol: 23 parts (3 equivalents)

Examples B1 to B3 and Comparative example B1

By use of a polyethylene terephthalate sheet film (T-100, manufactured by Toray, Japan. 100 μm) as the base material sheet, a coating solution with a composition shown below was coated by a bar coater at a ratio to 5.0 g/m$^2$ on drying and dried to obtain heat transfer image-receiving sheets of the present invention and Comparative example.

The peeling forces of the receiving layers of these image-receiving sheets were measured to obtain the results shown below in Table B1.

Polyester of Reference examples B1–B3 or Comparative reference example B1: 100.0 parts
Epoxy-modified silicone (X-22-3000E, manufactured by Shinetsu Kagaku: 8 parts
Amino-modified silicone (X-22-3050C, manufactured by Shinetsu Kagaku): 8 parts
Methyl ethyl ketone/toluene (weight ratio 1/1): 400 parts On the other hand, an ink composition for dye carrying layer with a composition shown below was prepared and coated and dried by a wire var on a polyethylene terephthalate film with a thickness of 6 μm applied on the back with a heat-resistant treatment to a coated amount after drying of 1.0 g/m$^2$ to obtain a heat transfer sheet.

C.I. Disperse Blue 24: 1.0 part
Polyvinyl butyral resin: 10.0 parts
Methyl ethyl ketone/toluene (weight ratio 1/1): 90.0 parts The above heat transfer sheet and the heat transfer image-receiving sheet of the present invention and Comparative example were superposed respectively with the respective dye layer and the dye receiving surface faced to each other, and printing was performed with a thermal head from the back of the heat transfer sheet under the conditions of an application voltage of 12.0 V, a pulse width of 16 msec. and a dot density of 6 dots/line. The resolutions of the images obtained were compared to give the results shown below in Table B1. Peeling force was measured by 180° test.

TABLE B1

| | Peeling force (g/cm) | Resolution |
|---|---|---|
| Example B1 | 500 | Good |
| Example B2 | 450 | " |
| Example B3 | 600 | " |
| Comparative example B1 | 150 | " |

We claim:

1. An image-transfer system comprising:

a dye donor sheet comprising a substrate sheet and a dye layer formed thereon, said dye layer comprising a dye and a binder; and an image-receiving sheet for receiving dye thermally transferred from said dye donor sheet, said image-receiving sheet comprising a base sheet and a dye receiving layer formed on at least one surface of said base sheet, said dye receiving layer comprising an acidic resin having an acid value of 2 or more.

2. The image-transfer system of claim 1, wherein said acidic resin is an acid modified polyester resin.

3. The image-transfer system of claim 1, wherein the dye is a dye having at least one primary to tertiary amine.

4. The image-transfer system of claim 1, wherein said dye is selected from the group consisting of an indoaniline dye, cyanoacetyl dye, and anthraquinone dye.

5. An image-transfer system comprising:

a dye donor sheet comprising a substrate sheet and a dye layer formed thereon, said dye layer comprising a dye and a binder; and an image-receiving sheet for receiving dye thermally transferred from said dye donor sheet, said image-receiving sheet comprising a base sheet and a dye receiving layer formed on at least one surface of said base sheet, said dye receiving layer being formed primarily of a polyester resin having a branched structure.

6. The image-transfer system of claim 5, wherein the branched structure polyester is formed under the presence of a polycarboxylic acid having three or four carboxyl groups or a polyol having three or four hydroxyl groups.

7. The image-transfer system of claim 6, wherein the polycarboxylic acid or polyol comprises 0.5 to 50 equivalent % of an acid component or alcohol component which constitutes the polyester resin having a branched structure.

* * * * *